US010913642B2

(12) United States Patent
Förander et al.

(10) Patent No.: US 10,913,642 B2
(45) Date of Patent: Feb. 9, 2021

(54) SIDE LIFT SPREADER FOR LIFTING INTERMODAL CONTAINERS, AND METHOD OF OPERATING A SIDE LIFT SPREADER

(71) Applicant: ELME SPREADER AB, Älmhult (SE)

(72) Inventors: Erik Förander, Virestad (SE); Örjan Karlsson, Lund (SE)

(73) Assignee: Elme Spreader AB

( * ) Notice: Subject to any disclaimer, the term of this patent is extended or adjusted under 35 U.S.C. 154(b) by 0 days.

(21) Appl. No.: 16/498,673

(22) PCT Filed: Mar. 23, 2018

(86) PCT No.: PCT/SE2018/050309

§ 371 (c)(1),
(2) Date: Sep. 27, 2019

(87) PCT Pub. No.: WO2018/182487

PCT Pub. Date: Oct. 4, 2018

(65) Prior Publication Data

US 2020/0079631 A1 Mar. 12, 2020

(30) Foreign Application Priority Data

Mar. 31, 2017 (SE) ..... 1750402

(51) Int. Cl.
*B66F 9/18* (2006.01)
*B66C 1/22* (2006.01)
*B66F 9/075* (2006.01)

(52) U.S. Cl.
CPC ..... *B66F 9/186* (2013.01); *B66C 1/223* (2013.01); *B66F 9/0755* (2013.01)

(58) Field of Classification Search
CPC ..... B66F 9/186; B66F 9/0755; B66C 1/223
See application file for complete search history.

(56) References Cited

U.S. PATENT DOCUMENTS 3,809,270 A * 5/1974 Peltonen ..... B66F 9/186 414/608
4,546,891 A * 10/1985 Lanigan, Sr. ..... B66C 19/007 212/327

(Continued)

FOREIGN PATENT DOCUMENTS

CN 201161785 Y 12/2008
CN 2017-85172 U 4/2011

(Continued)

OTHER PUBLICATIONS

People's Republic of China Ministry of Transportation; ISO standard 1161:1984; retrieved from https://www.chinesestandard.net/PDF/English.aspx/GBT1835-2006.

*Primary Examiner* — Kaitlin S Joerger
(74) *Attorney, Agent, or Firm* — Condo Roccia Koptiw LLP

(57) ABSTRACT

A side lift spreader (20) for lifting an upper intermodal transport container (10') and a lower intermodal transport container (10) stacked on each other comprises a container locking arrangement (30) arranged at a first longitudinal end of the spreader, the container locking arrangement (30) comprising an upper male lock insert configured to be connected to a bottom corner casting of the upper container (10') and a lower male lock insert configured to be connected to a top corner casting of the lower container (10), wherein said container locking arrangement (30) comprises an indicator configured to provide an indication if an attempt is made to connect the lower male lock insert to the bottom corner casting of the upper container (10').

20 Claims, 6 Drawing Sheets

(56) References Cited

U.S. PATENT DOCUMENTS

| | | | | | |
|---|---|---|---|---|---|
| 4,715,762 | A | | 12/1987 | Lanigan et al. | |
| 5,201,629 | A | * | 4/1993 | Simpson | B66F 9/07545 180/306 |
| 6,086,316 | A | * | 7/2000 | Sundermeijer | B66F 9/186 294/110.1 |
| 6,431,625 | B1 | * | 8/2002 | Copier | B66F 9/186 294/81.5 |

FOREIGN PATENT DOCUMENTS

| | | | |
|---|---|---|---|
| EP | 0638512 | A1 | 2/1995 |
| EP | 0701964 | A1 | 3/1996 |
| GB | 1318416 | A | 5/1973 |
| JP | H11-301998 | A | 11/1999 |
| NL | 9300079 | A | 8/1994 |
| NL | 1004817 | C2 | 6/1998 |
| WO | WO 2012-100586 | A | 8/2012 |

* cited by examiner

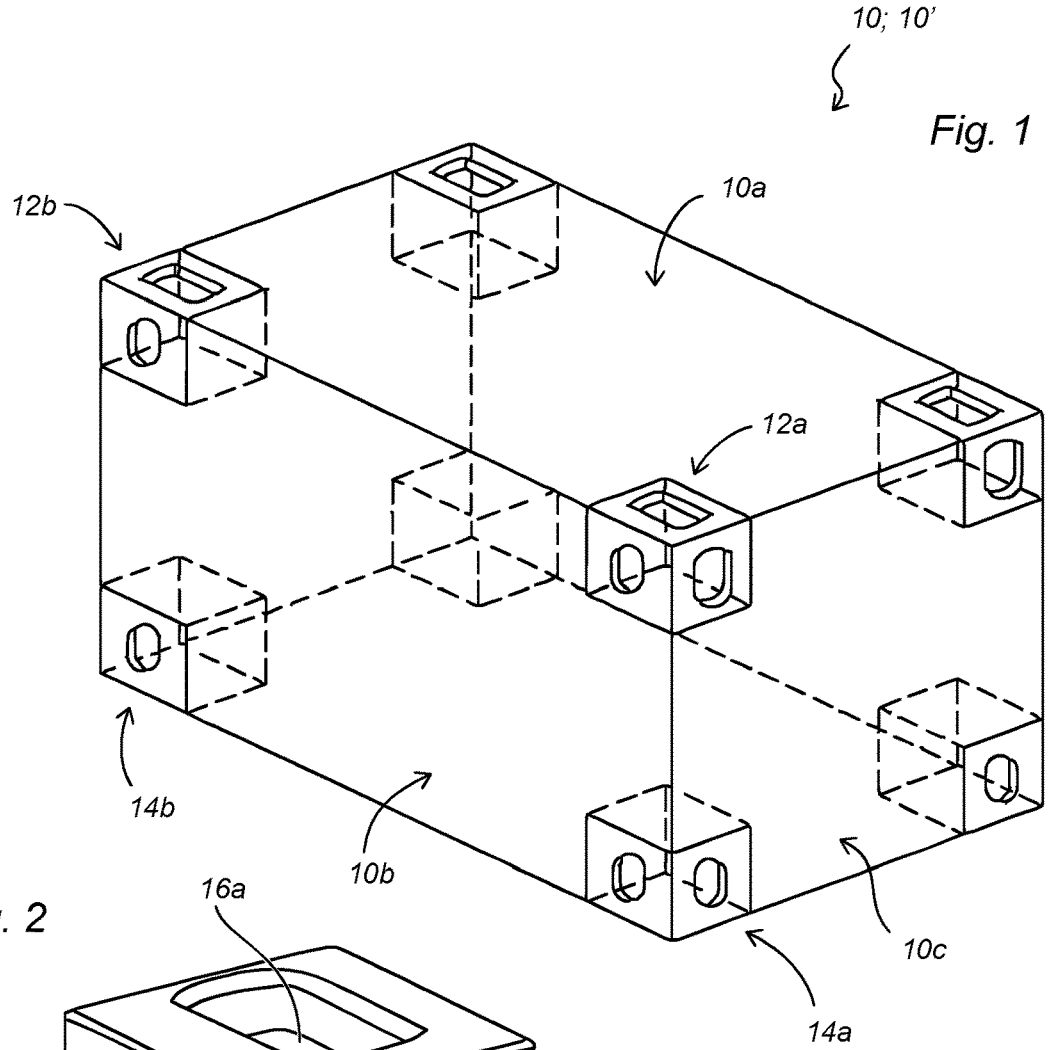
Fig. 1
Fig. 2
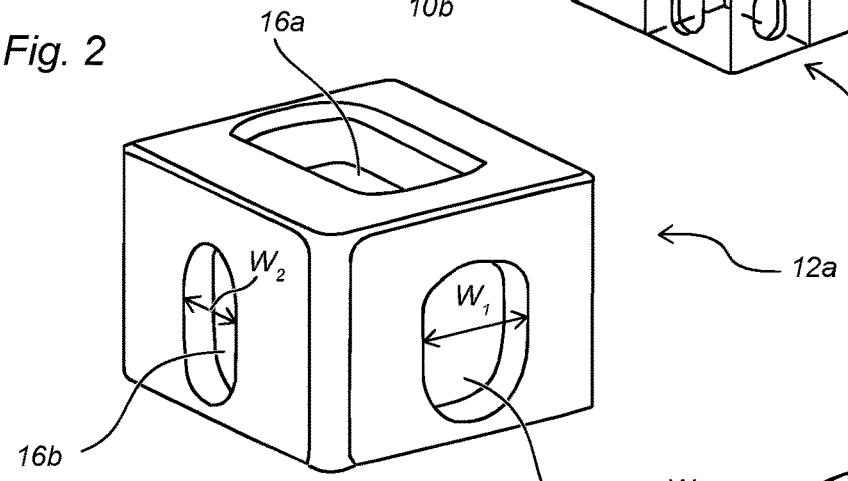
Fig. 3
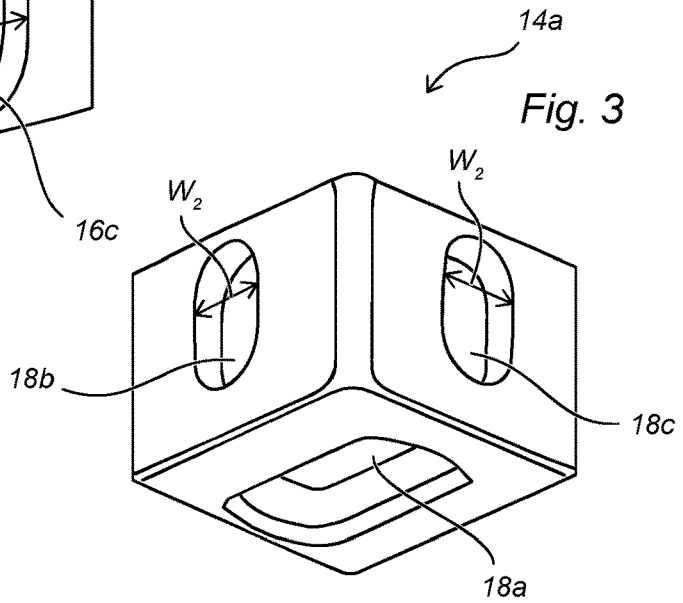

Fig. 11
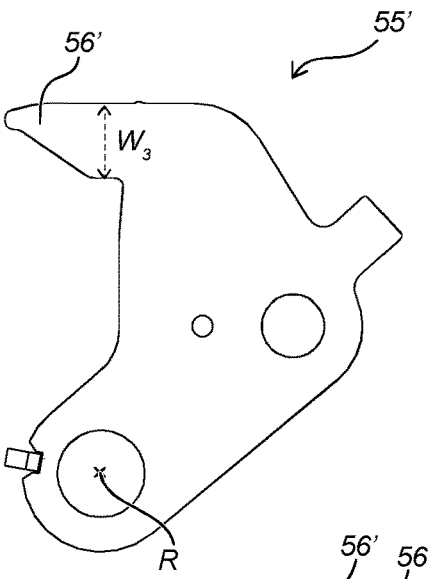
Fig. 12
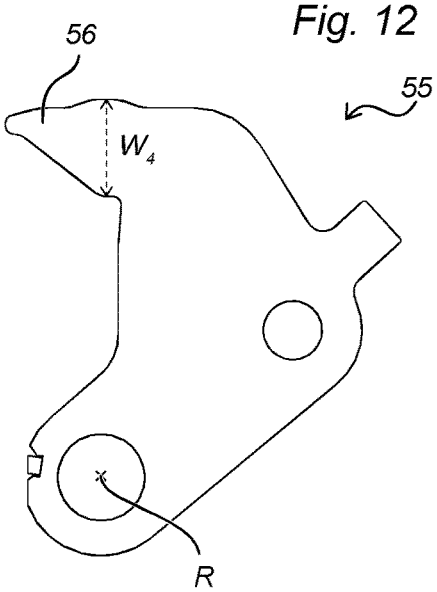
Fig. 14
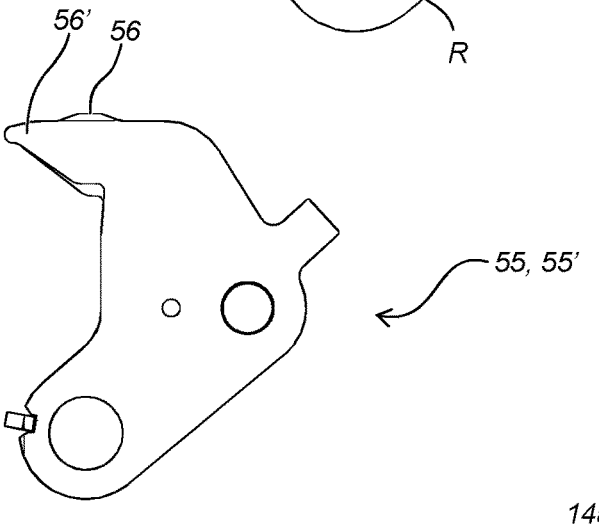
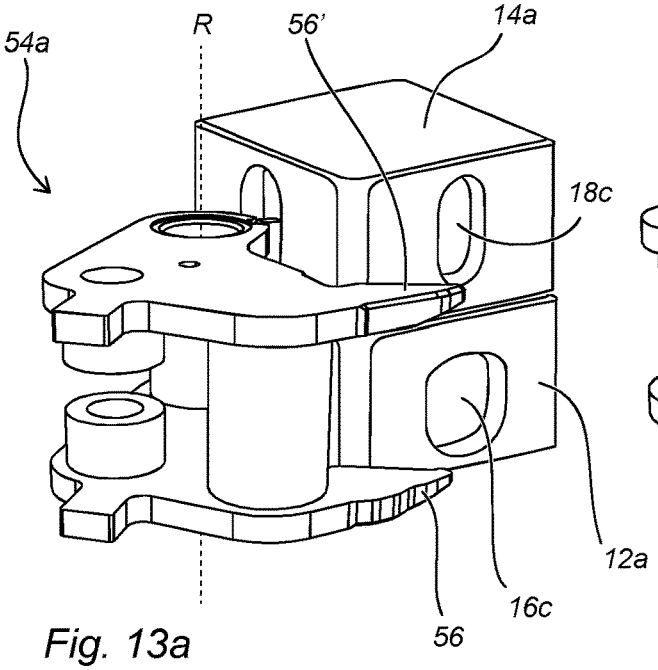
Fig. 13a
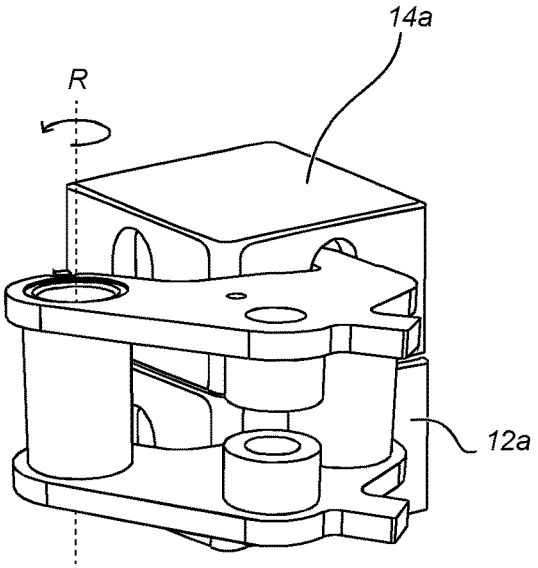
Fig. 13b

SIDE LIFT SPREADER FOR LIFTING INTERMODAL CONTAINERS, AND METHOD OF OPERATING A SIDE LIFT SPREADER

CROSS REFERENCE TO RELATED APPLICATIONS

This application is the National Stage Entry under 35 U.S.C. § 371 of Patent Cooperation Treaty Application No. PCT/SE2018/050309, filed Mar. 23, 2018, which claim priority from Swedish Patent Application No. 1750402-8, filed Mar. 31, 2017, contents of which are hereby incorporated by reference herein.

FIELD OF THE INVENTION

The present invention relates to a side lift spreader for lifting two intermodal transport containers. The invention also relates to a method of operating such a spreader.

BACKGROUND OF THE INVENTION

An intermodal container is a standardized shipping container which can be used across and transferred between different modes of transport, such as rail, truck and ship, without unloading and reloading the cargo inside the container. Containers and other types of rigid load carriers of different standard dimensions are normally handled with the aid of a container spreader or yoke, which may typically be carried by a truck or a crane. The spreader attaches to a container at lifting castings, which are often called corner castings as they are typically arranged in all corners of a standard 20- or 40-foot container. For the purpose, the spreader is provided with a plurality of twist-locks or other container locking arrangements, which are known in the art. Often, the spreader is telescopic so as to allow changing the distance between container locking arrangements along a longitudinal axis of the container, in order to accommodate for containers of different standard lengths. Standards for intermodal containers are specified by the International Organization for Standardization, ISO, e.g. in the standards ISO 668:2013 and ISO 1496-1:2013.

Side lift spreaders are generally used for lifting empty containers, since due to the relatively low weight of an empty container, it may be sufficient to connect to the corner castings of a single lateral side of the container. Side lift spreaders may typically be carried by a lifting truck for moving the containers within e.g. a cargo terminal area. Sometimes, two empty containers may be transported at a time, with one container stacked on the other. An exemplary side lift spreader for simultaneously handling two containers is shown in EP 0701964.

Empty containers may be stacked on top of each other on rather high container stacks; in recent years, it has become common to use stacks of heights up to nine ISO containers, which corresponds to a stack height of about 22.5 metres. It is difficult for the operator of the truck to control the position of the container and/or the spreader at such high levels. Every day, containers are damaged during handling, and needless to say, a container dropped to the ground may cause substantial damage as well as danger to people. Hence, there is an incessant strive to increase the safety and reliability of container handling. At the same time, there are also other requirements that need to be met by a spreader. By way of example, it should be possible to produce and operate at a reasonable cost, and it should be easy and convenient to operate.

SUMMARY OF THE INVENTION

It is an object of the present invention to solve, or at least mitigate, parts or all of the above-mentioned problems. To this end, there is provided a side lift spreader for lifting an upper intermodal transport container and a lower intermodal transport container in a single lifting operation, said upper and lower containers being stacked on each other, the spreader comprising a first container locking arrangement arranged at a first longitudinal end of the spreader, the first container locking arrangement comprising an upper male lock insert configured to be connected to a bottom corner casting of the upper container and a lower male lock insert configured to be connected to a top corner casting of the lower container, wherein said first container locking arrangement comprises an indicator configured to provide an indication if, or whether, an attempt is made to connect the lower male lock insert to the bottom corner casting of the upper container. In the event that an attempt is made to connect the lower male lock insert to the bottom corner casting of the upper container, there would simultaneously be an attempt to connect the upper male lock insert to a portion of the upper container above the level of the bottom corner casting of the upper container. If the container is a normal cargo container, this would typically result in the upper male lock insert making a dent in the cargo container door or wall before being blocked, and the truck operator realizing his/her mistake and trying again. However, if the cargo container is provided with a recess where the upper male lock insert attempts to enter, both male inserts may be moved to a position corresponding to a completed connection motion. In such a situation, the mistake may pass undiscovered, and the operator may attempt to try a lift. This would inevitably result in more severe damage to the container, and might even result in dropping the lower container, if the lift is somewhat successful initially. By way of example, refrigerated containers are sometimes provided with recessed doors, which may allow e.g. an upper side clamp to move freely in front of the door if a lower side clamp is connected to the bottom corner casting of the upper container.

According to an embodiment, said indicator may be configured to provide an indication if, or whether, an attempt is made to connect the lower male lock insert to the bottom corner casting of the upper container without the upper male lock insert engaging with the upper container.

According to an embodiment, said indicator may comprise a portion of the lower male lock insert geometrically shaped to prevent insertion of the lower male lock insert into the bottom corner casting of the upper container. Such an indicator is very simple and inexpensive, as it requires no extra parts to operate. Moreover, it is intrinsically very robust and unlikely to fail as long as the corner castings of the containers conform to the shapes specified in the established ISO standards; hence, according to an embodiment, said bottom corner casting may be a bottom corner casting pursuant to ISO 668:2013 and/or ISO 1396-1:2013. Obviously, the upper male lock insert may be geometrically shaped to allow insertion into the bottom corner casting of the upper container. According to an embodiment, said lower male lock insert may be adapted to be inserted into a gable lock opening of the top corner casting of the lower container, wherein said lower male lock insert has a horizontal width exceeding the horizontal width of a gable lock opening of the bottom corner casting of the upper container. The standardized, differing widths of the upper and lower gable lock openings thereby provide a simple and reliable means of distinguishing between an upper and a bottom corner casting. A gable lock opening of a bottom corner casting of an ISO container has a horizontal width of 51 mm; hence, the horizontal width of the lower male lock insert preferably exceeds 51 mm. More preferably, it exceeds 54 mm to provide some margin. The upper male lock insert may have a horizontal width of less than the horizontal width of the gable lock opening of the bottom corner casting of the upper container, i.e. of less than 51 mm, or less than 48 mm to provide some margin. There are however also other, alternative ways to distinguish between the ISO-standardized top and bottom corner castings, since they differ geometrically also in other aspects than the shapes and dimensions of the gable openings. For example, the longitudinal side lock opening of a bottom corner casting is located close to the top of the corner casting, whereas the longitudinal side lock opening of a top corner casting is located close to the bottom of the corner casting. Also this difference may be used for designing a male lock insert that is capable of engaging with one but not the other.

According to an embodiment, said lower male lock insert may be configured as a lower side clamp pivotal about a substantially vertical axis. Such a configuration may allow, in a simple manner, maintaining the lower side clamp retracted behind a plane defined by the longitudinal side of the container while positioning the spreader prior to connection. Thereby, the risk of damaging the lower male lock insert due to an impact between spreader and container, during positioning, is reduced. Moreover, it can be pivoted to a retracted position in which it is completely received in the spreader head. According to an embodiment, the upper male lock insert may be configured as an upper side clamp pivotal about said substantially vertical axis. Such a configuration may protect also the upper side clamp from impact. Each of the side clamps may have the general shape of a claw, wherein the lower male lock insert may be wider at the base than the upper male lock insert to prevent a complete insertion of the lower male lock insert into the bottom corner casting of the upper container. As explained above, the base of the lower side clamp may have a horizontal width exceeding e.g. 51 mm, or 54 mm to provide some margin, whereas the base of the upper side clamp may have a width of less than 51 mm, or less than 48 mm to provide some additional safety margin. According to a particularly simple configuration, the upper and lower side clamps may be rigidly connected to a common shaft for simultaneous operation, and the respective horizontal base widths of the side clamps may differ in the above described aspect as measured along a vertical plane comprising the shaft axis and intersecting the side clamps.

According to an embodiment, said indicator may be operably connected to a control system of the spreader, said control system being configured to generate an electronic indication signal to a truck carrying the spreader. Thereby, an operator of the truck may be notified via e.g. the truck's control system, and/or the truck may be configured to automatically limit the truck's maximum speed and/or prevent a lifting operation to be commenced. In the case of a mechanical indicator, such as a male lock insert shaped to allow engagement with only the upper corner casting of the lower container, the mechanical indicator may be provided with an electronic position sensor configured to provide said indication signal to the control system.

According to an embodiment, said first container locking arrangement may further comprise a lifting hook for connecting to a longitudinal side lock opening of the top corner casting of the lower container. A lifting hook may be rigidly connected to the spreader head, and may engage with the corner casting at the very abutment face of the spreader head. It may typically carry a higher vertical load than a pivotal side clamp. In such a configuration, the upper and lower side clamps would primarily serve for holding the two containers together, while the lifting hook would carry a majority of the vertical load of both containers when lifting. Typically, the lifting hook may be provided with a barb extending upwards to engage with the upper, inner edge of the lock opening.

According to an embodiment, the first container locking arrangement may further comprise a distance sensor configured to detect a distance between the corner casting of the lower container and a corner casting abutment face of the first container locking arrangement. The distance sensor may be configured to detect at least three different states, wherein a first state corresponds to the abutment face of the container locking arrangement being sufficiently close to the corner casting to allow the lifting hook to freely engage with an inner edge of the longitudinal side lock opening; a second state corresponds to the distance between the corner casting of the lower container and the corner casting abutment face being shorter than a predetermined distance, but too long to warrant that the lifting hook can freely engage with an inner edge of the longitudinal side lock opening; and a third state corresponds to no corner casting being detected. The distance sensor may comprise a movable indicator body configured to abut the corner casting, wherein said third state corresponds to the movable indicator body being out of contact with the corner casting.

According to an embodiment, the first container locking arrangement may further comprise a presence sensor configured to sense, when the container locking arrangement has been connected to the upper corner casting of the lower container, the presence of the lower corner casting of the upper container. Such a sensor adds an extra level of safety, and may be configured to generate a signal indicating whether the upper container is correctly positioned for lifting. The presence sensor may comprise a movable indicator body configured to abut an outer, vertical surface of the corner casting.

According to an embodiment, the side lift spreader may further comprise a second container locking arrangement arranged at a second longitudinal end of the spreader, the second container locking arrangement being configured in accordance with the first container locking arrangement as defined above. Having a container locking arrangement as described above at each end of the spreader even further reduces the risk of damaging or dropping a container.

According to another aspect of the invention, parts or all of the above mentioned problems are solved, or at least mitigated, by a method of lifting an upper intermodal transport container and a lower intermodal transport container in a single lifting operation, the method comprising attempting insertion of a male lock insert into one of a top corner casting of the lower container and a bottom corner casting of the upper container; based on said attempt, determining whether said one of a top corner casting of the lower container and a bottom corner casting of the upper container is the top corner casting of the lower container or the bottom corner casting of the upper container. Such a method reduces the risk of accidents as described above.

According to an embodiment, said determination may be based on said male lock insert being geometrically shaped to allow insertion into the top corner casting of the lower container, and to prevent insertion into the bottom corner casting of the upper container. Said male lock insert may be configured to be inserted into a gable lock opening of the top corner casting of the lower container, wherein said male lock insert has a horizontal width exceeding the horizontal width of a gable lock opening of the bottom corner casting of the upper container.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein:

FIG. 1 is a schematic illustration in perspective of an intermodal container;

FIG. 2 is a schematic illustration in perspective of a top corner casting of the intermodal container of FIG. 1;

FIG. 3 is a schematic illustration in perspective of a bottom corner casting of the intermodal container of FIG. 1;

FIG. 11 is a schematic illustration of the contour of an upper side clamp plate of the side clamp assembly of FIG. 10;

FIG. 12 is a schematic illustration of the contour of a lower side clamp plate of the side clamp assembly of FIG. 10;

FIG. 13*a* is a schematic illustration in perspective of the side clamp assembly of FIG. 10 prior to connecting to a pair of corner castings of the pair of containers of FIG. 5;

FIG. 13*b* is a schematic illustration in perspective of the side clamp assembly of FIG. 10 after connecting to the pair of corner castings of the pair of containers of FIG. 5; and FIG. 14 is a schematic illustration of the contour of the lower side clamp plate of FIG. 11 on top of the contour of the upper side clamp plate of the side clamp assembly of FIG. 10.

DETAILED DESCRIPTION OF THE EXEMPLARY EMBODIMENTS

Figure 4:
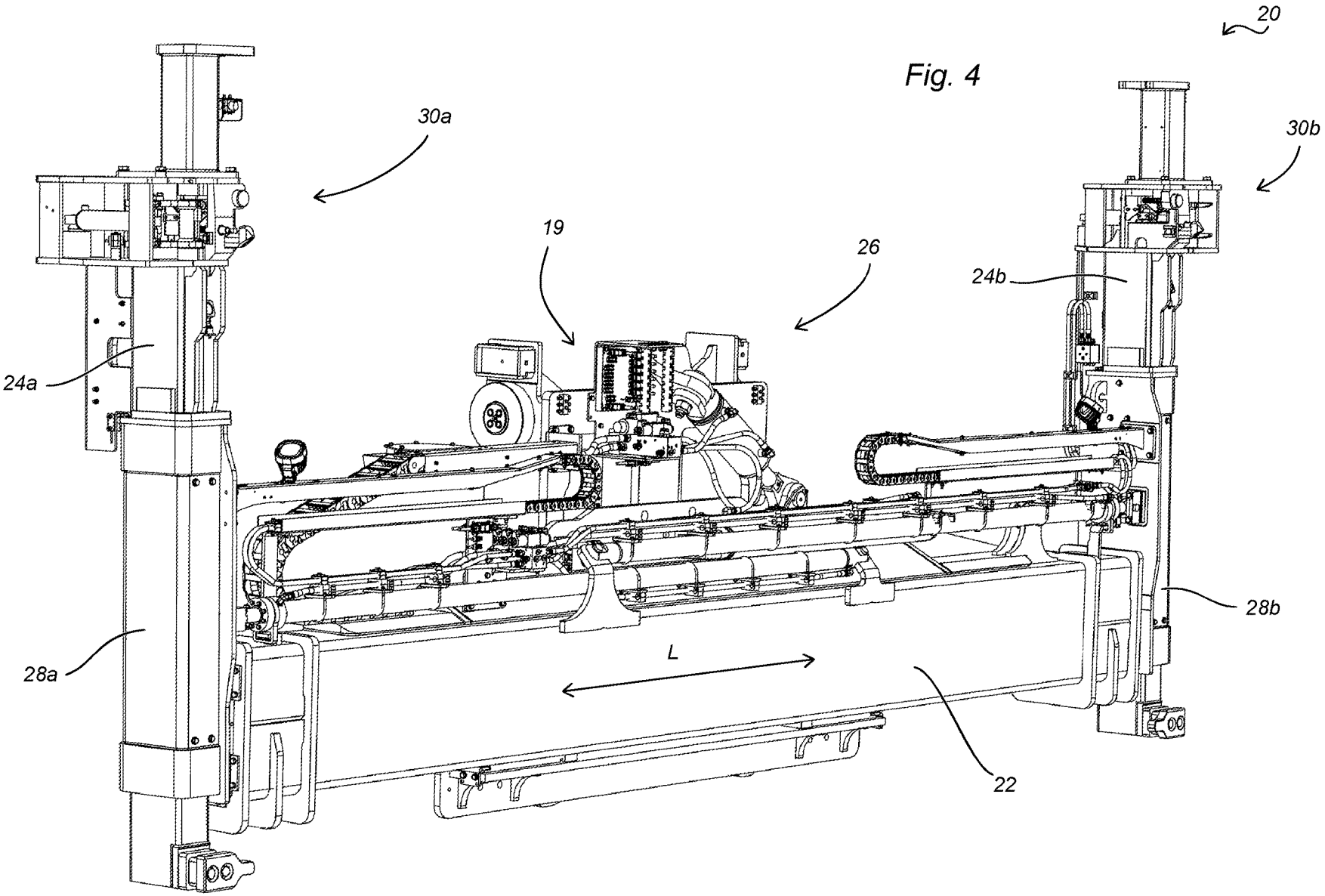
FIG. 4 is a diagrammatic view in perspective of a side lift spreader for handling intermodal containers.

FIG. 1 schematically illustrates an intermodal container 10 according to the above-mentioned ISO standards. The container 10, which for clarity is illustrated transparent, has a top face 10*a*, a first longitudinal side 10*b*, and a first short side or gable side 10*c*. The container also has a bottom face, a second longitudinal side, and a second gable side, which are located opposite the top face, first longitudinal side, and first gable side, respectively. Each corner of the container 10 is provided with a respective corner casting for attaching a respective container locking arrangement, for the purpose of facilitating the handling of the container 10, and for locking the container 10 to other containers or to the deck of a freight ship. Hence, the container top corners which define the top corners of the first longitudinal side 10*b* are provided with a first top corner casting 12*a* and a second top corner casting 12*b*. Similarly, the container bottom corners which define the bottom corners of the first longitudinal side 10*b* are provided with a first bottom corner casting 14*a* and a second bottom corner casting 14*b*.

FIG. 2 illustrates the top corner casting 12*a* in greater detail, in the same perspective as in FIG. 1. It is provided with a top face lock opening 16*a*, a longitudinal side lock opening 16*b*, and a gable lock opening 16*c*, each of which is configured to receive and engage with a male insert of a container locking arrangement, such as a lifting hook or a twist-lock. As illustrated in FIG. 2, the gable lock opening 16*c* has a horizontal width $W_1$ exceeding the horizontal width $W_2$ of the longitudinal side lock opening 16*b*. This is because the gable lock openings 16*c*, according to the standard, were originally intended for lifting hooks dimensioned for lifting laden containers, which for reasons of strength are typically wider than e.g. a twist-lock. The top face lock opening 16*a* has the same width as the gable lock opening 16*c*, such that a lifting hook can enter the top face lock opening 16*a* and engage with the upper edge of the gable lock opening 16*c* from the inside. As the height/width ratio of the gable lock opening 16*c* is relatively moderate compared to the height/width ratio of the longitudinal side lock opening 16*b*, it is also less suitable for twist-locks compared to the longitudinal side lock opening 16*b*.

FIG. 3 illustrates the bottom corner casting 14*a* in greater detail, and as seen obliquely from below. It is provided with a bottom face lock opening 18*a*, a longitudinal side lock opening 18*b*, and a gable lock opening 18*c*, each of which is configured to receive and engage with a male insert of a container locking arrangement, such as a twist-lock. As illustrated in FIG. 3, the longitudinal side lock opening 18*b* and the gable lock opening 18*c* each have the same horizontal width $W_2$ as the longitudinal side lock opening 16*b* of the top corner casting 12*a* (FIG. 2).

Referring back to FIG. 1, a side lift spreader is a container handling device configured for handling empty containers 10 by connecting container locking arrangements, such as lifting hooks or twist locks, only at corner castings arranged at a single longitudinal side 10*b* of the container. For example, a single-container side lift spreader generally attaches to the top corner castings 12*a*, 12*b* of a single longitudinal side 10*b*. As each corner casting may be accessible from three different directions, it is however not necessary that the container locking arrangements access the corner castings 12*a*, 12*b* from the longitudinal side. It is possible that the container locking arrangements access the two corner castings 12*a*, 12*b*, arranged at the same longitudinal side 10*b* of the container, from above or from the gables 10*c* of the container 10. In other words, even though a side lift spreader approaches the container 10 from the longitudinal side 10*b* of the container 10 it is possible that the container locking arrangements of the side lift spreader access the corner castings 12*a*, 12*b* from another direction, i.e. from the gables 10*c* of the container 10 or from above. Thus, a side lift spreader may handle a container 10 by connecting container locking arrangements to e.g. two top corner castings 12*a*, 12*b* of the container, wherein the remaining two top corner castings of the container are not used by the side lift spreader for handling the container 10. In this sense a side lift spreader is clearly different from a top-lift spreader that handles a container 10 by connecting container locking arrangements to all four upper corner castings of the container. Such top-lift spreaders are needed for lifting laden containers, which are much heavier than empty containers.

FIG. 4 illustrates a side-lift spreader 20 for handling two mutually stacked intermodal containers according to the above-mentioned ISO standards. The spreader 20 comprises a horizontal main beam 22, which supports a pair of vertical carrier beams 24*a-b* at respective ends thereof. The vertical carrier beams 24*a-b* are telescopically connected to the main beam 22 via respective travelling beams (not illustrated), which are configured to telescopically extend from the respective ends of the main beam 22 along the longitudinal axis L of the main beam 22. Thereby, the horizontal distance between the vertical carrier beams 24*a-b* can be varied to allow lifting containers of different lengths. A truck mast coupling 26 is mounted centrally on the main beam 22, and is configured to be connected to the mast of a lifting truck (not illustrated). Each vertical carrier beam 24*a*, 24*b* is vertically guided in a respective vertical sleeve 28*a*, 28*b*, which is welded to a distal end of the respective travelling beam (not illustrated). Adjacent to its top, each vertical carrier beam 24*a-b* is provided with a respective container locking arrangement 30*a*, 30*b* for connecting to corner castings in a manner that will be elucidated in detail further below. The container locking arrangements 30*a*, 30*b* are sometimes also referred to as spreader heads. A spreader controller 19 is operably connected to various sensors and actuators of the spreader 20 in a non-illustrated manner.

Figure 5:
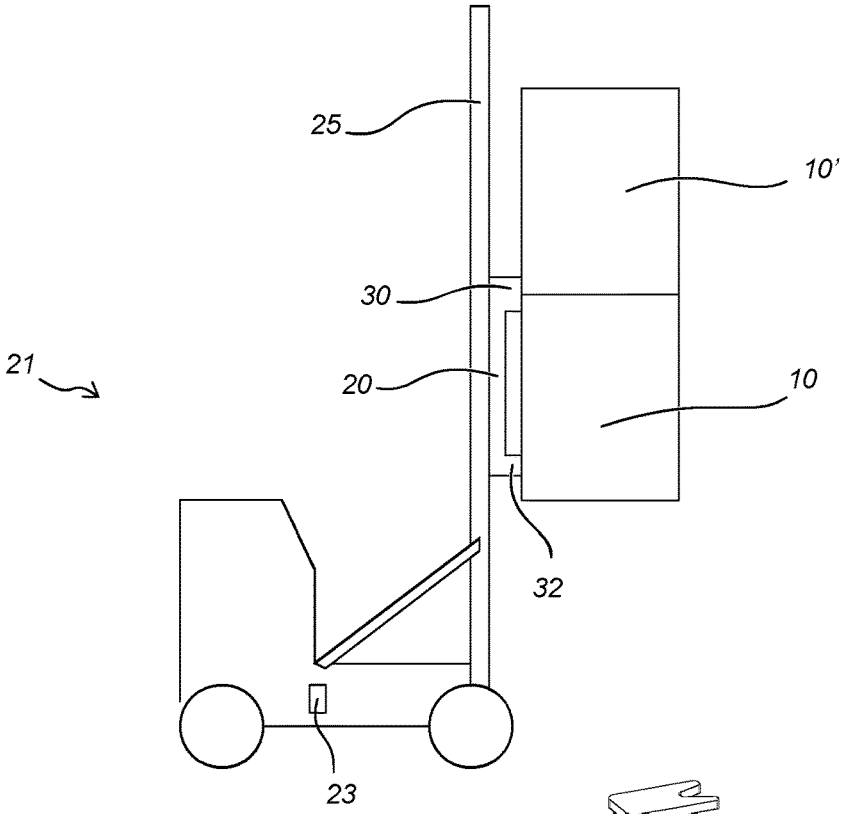
FIG. 5 is a schematic side view of a lifting truck provided with the spreader of FIG. 4 carrying a pair of containers of the type illustrated in FIG. 1.

FIG. 5 schematically illustrates the spreader 20 of FIG. 4 connected to a lifting truck 21. The spreader 20 is vertically movable along a mast 25 to allow e.g. arranging of containers in high stacks. In the illustration of FIG. 5, the spreader 20 is connected to, and lifts, a pair of containers 10 and 10'. The lower container 10 is attached to the container locking arrangements 30 at its top corner castings 12*a*, 12*b* (FIG. 1), and its longitudinal side 10*b* (FIG. 1) rests on a container side support 32. The upper container 10' rests on the lower container 10, and its bottom corner castings 14*a*, 14*b* (FIG. 1) are attached to the container locking arrangements 30. A truck control system 23 is operably connected to the spreader control system 19 (FIG. 4) in a non-illustrated manner, and allows communicating warnings from the spreader 20 to the driver of the truck 21.

Figure 6:
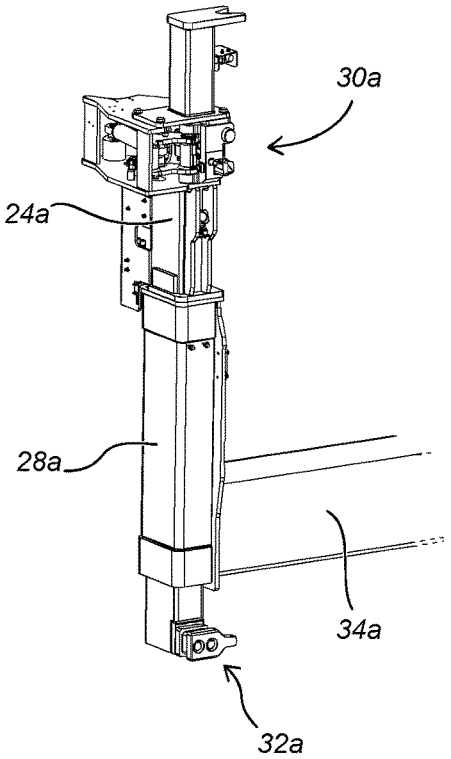
FIG. 6 is a schematic view in perspective of a portion of the spreader of FIG. 4.

FIG. 6 illustrates a first vertical carrier beam 24*a* of said pair of vertical carrier beams 24*a-b*, as carried by the vertical sleeve 28*a*. At its bottom end, the vertical carrier beam is provided with a container side support 32*a* which is configured to, once the container locking arrangement 30*a* has attached to the container 10 (FIG. 1), abut and support the longitudinal side 10 of the container 10. In the view of FIG. 6, the main beam has been removed for clarity of illustration, to reveal the travelling beam 34*a* welded to the vertical sleeve 28*a*.

Figure 7:
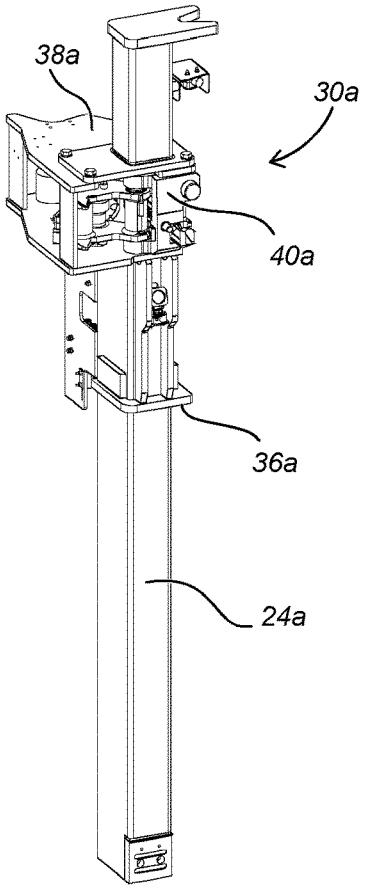
FIG. 7 is a schematic view in perspective of a vertical carrier beam of the spreader of FIG. 4.

FIG. 7 illustrates the first vertical carrier beam 24*a* as removed from the vertical sleeve 28*a* (FIG. 6). A horizontal flange 36*a* of the vertical carrier beam 24*a* is configured to rest upon the upper end of the vertical sleeve 28*a*; otherwise, the vertical carrier beam 24*a* is free to slide in the sleeve 28, in order to compensate for any differences in the horizontal alignment between the pair of container locking arrangements 30*a-b* (FIG. 4) and the container 10 to be lifted (FIG. 1) prior to connection. A housing 38*a* protects the container locking arrangement 30*a* from impacts, and a front face portion 40*a* of the housing is configured to abut the corner castings 12*a*, 14*a* at the longitudinal sides 10*b* of the containers 10 to be lifted.

Figure 8A:
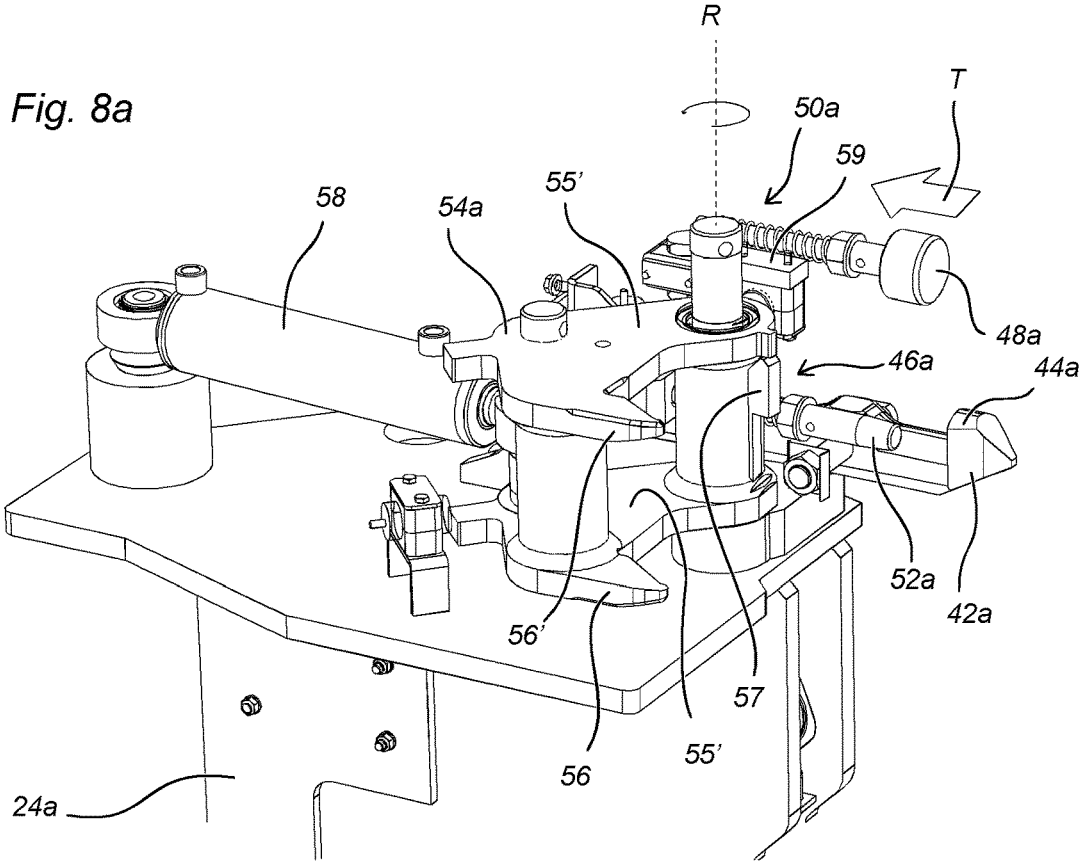
FIG. 8*a* is a diagrammatic view in perspective of a container locking arrangement of the vertical carrier beam of FIG. 7, illustrated with housing parts broken away, and as seen from a first perspective.
Figure 8B:
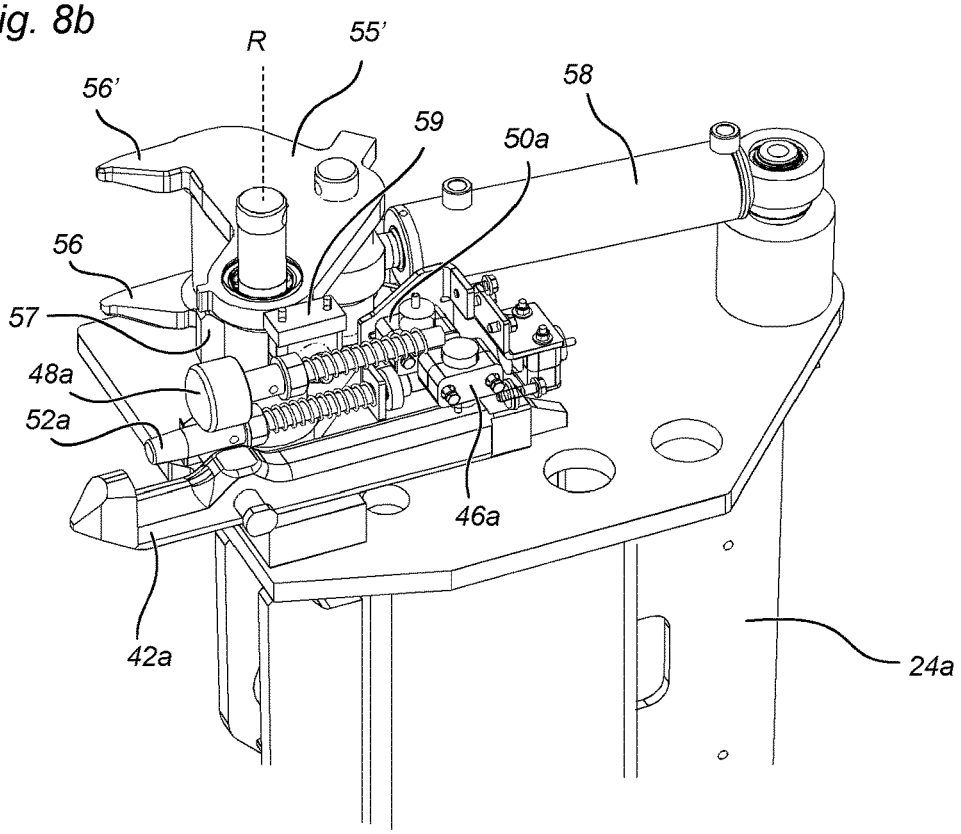
FIG. 8*b* is a diagrammatic view in perspective of the container locking arrangement of FIG. 8*a*, again illustrated with housing parts broken away, and as seen from a second perspective.

FIGS. 8*a-b* illustrate the first container locking arrangement 30*a* in detail, and with most of the housing 38*a* removed for clarity of illustration. The container locking arrangement 30*a* comprises a lifting hook 42*a* for connecting to the longitudinal side lock opening 16*b* (FIG. 1) of the top corner casting 12*a* of the lower container 10 (FIG. 1). The lifting hook 42*a* is rigidly attached to the spreader head, and is provided with a barb 44*a* extending upwards to engage with the upper, inner edge of the lock opening 16*b*.

An upper container presence sensor 46*a* has an indicator body 48*a* movable along a direction T transversal to the longitudinal direction L (FIG. 4), and is configured to detect the presence of the upper container 10' when the indicator body 48*a* is pressed along the direction T by the bottom corner casting 14*a* (FIG. 3) of the upper container 10' (FIG. 5).

A lower container distance sensor 50*a* comprises an indicator body 52*a* configured to be pressed along the direction T by the top corner casting 12*a* (FIG. 2) of the lower container 10 (FIG. 5), and thereby detect whether the abutment face 40*a* (FIG. 7) of the container locking arrangement 30*a* is sufficiently close to the corner casting 12*a* to allow the barb 44*a* to freely engage with the inner edge of the longitudinal side lock opening 16*b* (FIG. 2). Once the containers 10, 10' are lifted, the detected distance between the corner casting 12*a* and the abutment face 40*a* of the container locking arrangement 30*a* also serves as an indicator of whether the lifting hook 42*a* remains properly engaged with the longitudinal side opening 16*b*.

A side clamp assembly 54*a* comprises a lower side clamp plate 55, defining a claw-shaped lower side clamp 56, and an upper side clamp plate 55', defining a claw-shaped upper side clamp 56'. The side clamp assembly 54*a* is pivotally connected to the vertical carrier beam 24*a* to pivot about a vertical axis R between an inner position, which is illustrated in FIGS. 8*a-b*, and an outer position, in which the lower side clamp 56 engages with the gable lock opening 16*c* of the top corner casting 12*a* of the lower container 10 (FIG. 5), and the upper side clamp 56' engages with the gable lock opening 18*c* of the bottom corner casting 14*a* of the upper container 10'. A hydraulic cylinder 58 has one end pivotally attached to the vertical carrier beam 24*a*, and the other end pivotally attached to the side clamp assembly 54*a*, to move the side clamp assembly 54*a* between the inner and outer positions. An indicator body 57 is configured to rotate with the side clamp assembly 54*a*, and when the side clamp assembly 54*a* is in the outer position, interact with an inductive sensor 59 to generate a side clamp insertion confirmation signal. The sensors 46*a*, 50*a*, and 59 are operably connected to the spreader control system 19 (FIG. 4) and the truck control system 23 (FIG. 5).

Figure 9A:
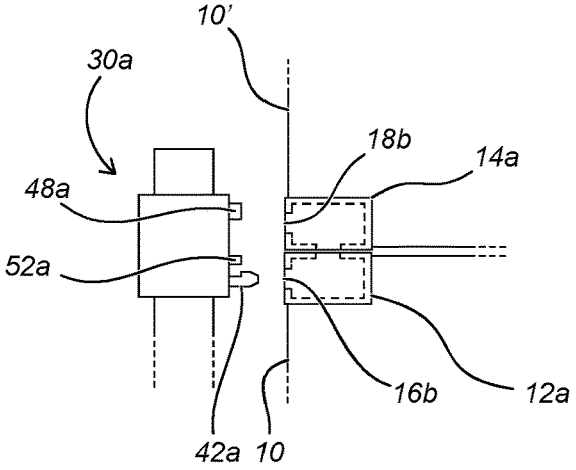
FIG. 9*a* is a schematic side view of the container locking arrangement of FIGS. 8*a*-*b* prior to connecting to a pair of containers.
Figure 9B:
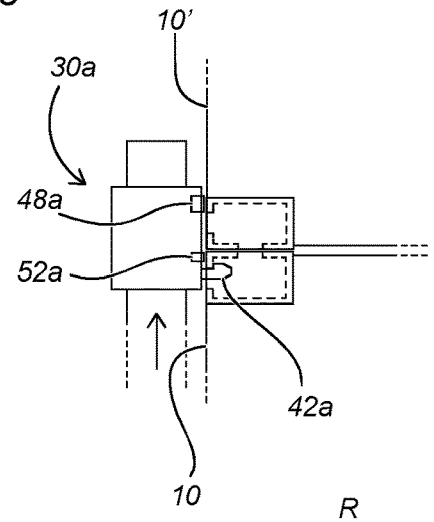
FIG. 9*b* is a schematic side view of the container locking arrangement of FIG. 9*a* after connecting to the pair of containers.

FIGS. 9*a-b* schematically illustrate the engagement between the lifting hook 42*a* and the lower container 10. From an initial position illustrated in FIG. 9*a*, the spreader is moved forward, such that the lifting hook 42*a* is inserted into the longitudinal side lock opening 16*b* of the top corner casting 12*a* of the lower container 10. Going from the position of FIG. 9*a* to the position of FIG. 9*b*, the indicator body 48*a* of the upper container presence sensor 46*a* will be pressed into the spreader head housing 38*a* (FIG. 7), thereby indicating to the control system 19 (FIG. 4) of the spreader 20 that the spreader 20 is simultaneously engaging with two containers 10, 10'. At the same time, the indicator body 52*a* of the distance sensor 50*a* will be pressed into the spreader head housing 38*a*, thereby indicating to the control system 19 of the spreader 20 that the lifting hook 42*a* has been sufficiently inserted to engage with the inner upper edge of the longitudinal side lock opening 16*b* of the upper corner casting 12*a* of the lower container 10. After having inserted the side clamps 56', 56 (FIGS. 8*a-b*) into the respective gable lock openings 16*c*, 18*c* and received confirmation signals from the lower container distance sensor 50*a* and the side clamp position sensor 59, the spreader allows lifting the containers 10, 10' in the direction of the arrow in FIG. 9*b*.

Figure 9C:
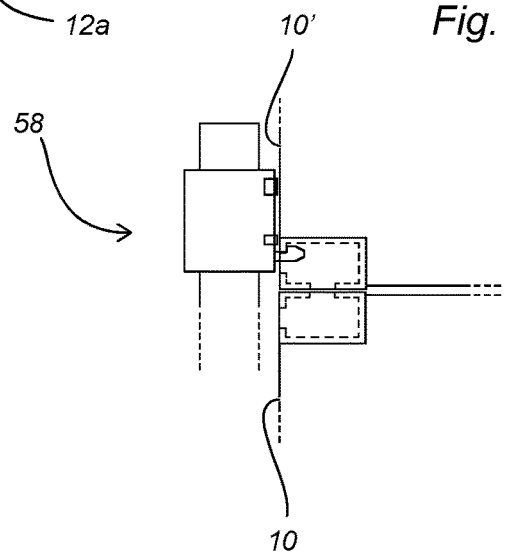
FIG. 9*c* is a schematic side view of the container locking arrangement of FIG. 9*a* after connecting to only an upper container of said pair of containers.

FIG. 9*c* illustrates a potentially dangerous situation which may occur if the spreader 20 is not level with the containers 10, 10' to be lifted. In such a situation, one of the container locking arrangements, such as the container locking arrangement 30*b* of FIG. 4, may correctly engage with the lower container 10 in the manner illustrated in FIG. 9*b*, whereas the other container locking arrangement 30*a* may incorrectly engage with the upper container 10' in the manner illustrated in FIG. 9*c*. If the gable side 10*c* (FIG. 1) of the upper container 10' is shaped to allow the upper side clamp 56' to be fully moved to the outer position, the spreader 20 may generate false confirmation signals permitting a lift. As one of the container locking arrangements 30*b* (FIG. 4) will lift both the containers 10, 10', and the other container locking arrangement 30*a* will lift only the upper container 10', the containers 10, 10' may be damaged, and in the worst case, dropped to the ground. However, the side clamp assembly 54*a* is shaped to reduce the risk of arriving at such a situation.

Figure 10:
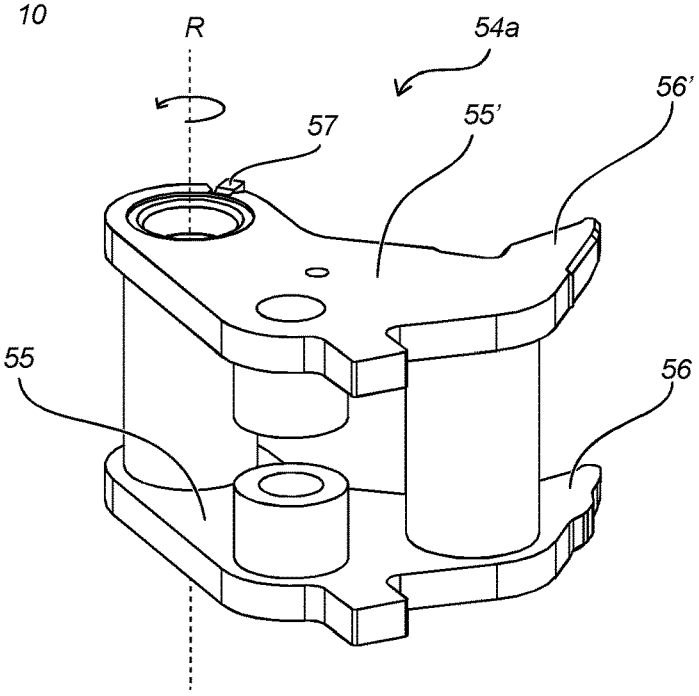
FIG. 10 is a schematic view in perspective of a side clamp assembly.

FIG. 10 illustrates the side clamp assembly 54*a* in isolation, such that the lower and upper side clamp plates 55, 55' are clearly visible.

FIG. 11 illustrates the outer contours of the upper side clamp plate 55'. The upper side clamp 56' has a horizontal width $W_3$, as measured in a radial direction with respect to the axis R of rotation. The horizontal width $W_3$ is inferior to the horizontal width $W_2$ of the lower gable lock opening 18*c* (FIG. 3) of the upper container 10' (FIG. 5), thereby allowing the upper side clamp 56' to be fully inserted into the lower gable lock opening 18*c*.

FIG. 12 illustrates the outer contours of the lower side clamp plate 55. The lower side clamp 56 has a horizontal width $W_4$, as measured in a radial direction with respect to the axis R of rotation, which is inferior to the horizontal width $W_1$ of the upper gable lock opening 16*c* (FIG. 2) of the lower container 10 (FIG. 5), thereby allowing the side clamp 56 to be fully inserted into the upper gable lock opening 16*c*.

FIGS. 13*a-b* illustrate the insertion of the side clamps 56', 56 into the upper corner casting 12*a* of the lower container 10 (FIG. 5) and the lower corner casting 14*a* of the upper container 10' (FIG. 5). FIG. 13*a* illustrates the side clamp assembly 54*a* in the inner, retracted position of FIGS. 7-8, whereas FIG. 13*b* illustrates the side clamp assembly 54*a* in the outer position. As the upper side clamp 56' is fully insertable in the lower gable lock opening 18*c* of the upper container 10', and the lower side clamp 56 is fully insertable in the upper gable lock opening 16*c* of the lower container 10, the side clamp assembly 54*a* can engage with both containers 10, 10' when the container locking arrangement 30*a* is in the position illustrated in FIG. 9*a*.

Now referring back to FIG. 12, the horizontal width $W_4$ of the lower side clamp 56 is wider than the horizontal width $W_2$ of the lower gable lock opening 18*c* (FIG. 3) of the upper container 10' (FIG. 5), which prevents the lower side clamp 56 to be fully inserted into the lower gable lock opening 18*c* of the upper container. Thereby, when attempting to connect the container locking arrangement 30*a* in the manner illustrated in FIG. 9*b*, the side clamp assembly 54*a* will be mechanically blocked from fully moving to the outer position, and the side clamp position sensor 59 (FIGS. 8*a-b*) will not generate any side clamp insertion confirmation signal.

According to the above mentioned ISO standards, $W_1$ should be about 63.5 mm, and $W_2$ should be about 51 mm; hence, $W_3$ should be less than about 51 mm, whereas $W_4$ should be between about 51 mm and about 63.5 mm. $W_4$ may preferably exceed 54 mm to provide some safety margin.

FIG. 14 illustrates the contours of the side clamp plates 55, 55' when placed on top of each other. The illustration clearly shows a wider portion of the lower side clamp 56, which allows insertion into the wider, upper gable lock opening 16*c* (FIG. 2) of an ISO container 10 (FIG. 1).

Hereinbefore, the first container locking arrangement 30*a* (FIG. 4) has been described in detail. It will be appreciated that the second container locking arrangement 30*b* may be configured in a substantially identical manner for connecting to the corner castings 12*b*, 14*b* (FIG. 1) of the containers 10, 10' (FIG. 5).

The concepts herein have mainly been described above with reference to a few embodiments. However, as is readily appreciated by a person skilled in the art, other embodiments than the ones disclosed above are equally possible within the scope of the invention, as defined by the appended patent claims.

For example, the lower side clamp 56 need not be shaped to prevent insertion into the lower gable lock opening 18*c* of the upper container 10'. As an exemplary though less preferred alternative, the spreader head may be provided with a camera and image processing circuitry configured to detect whether a gable lock opening 18*c* is present in front of the upper side clamp 56', and of not, generate an error signal.

The invention claimed is:

1. A side lift spreader for lifting two or more stacked intermodal transport containers, each of said containers having at least two top corner castings with at least one opening of a first geometry, and at least two bottom corner castings with at least one opening of a second geometry, wherein the first and second geometries are different, the spreader comprising:

a first container locking arrangement arranged at a first longitudinal end of the spreader, the first container locking arrangement comprising:

an upper male lock insert configured to be connected to the bottom corner casting of an upper container;

a lower male lock insert configured to be connected to the top corner casting of a lower container, wherein a portion of said lower male lock insert has a geometry such that said portion is prevented from fitting in the opening of the bottom corner casting; and an indicator configured to provide an indication whether the lower male lock insert is properly connected to the top corner casting.

2. The side lift spreader of claim 1, wherein said indicator comprises an indicator body configured to interact with an inductive sensor when the lower male lock insert is properly connected to the top corner casting.

3. The side lift spreader of claim 2, wherein the indicator body is too distant from the inductive sensor to generate an indication when said lower male lock insert is inserted into the bottom corner casting of the upper container.

4. The side lift spreader according to claim 1, wherein said lower male lock insert is configured as a lower side clamp pivotal about a substantially vertical axis.

5. The side lift spreader according to claim 4, wherein the upper male lock insert is configured as an upper side clamp pivotal about said substantially vertical axis.

6. The side lift spreader according to claim 1, wherein said indicator is operably connected to a control system of the spreader, said control system being configured to generate an electronic indication signal to a truck carrying the spreader.

7. The side lift spreader according to claim 1, wherein said first container locking arrangement further comprises a lifting hook for connecting to a longitudinal side lock opening of the top corner casting of the lower container.

8. The side lift spreader according to claim 1, wherein the first container locking arrangement further comprises a distance sensor configured to detect a distance between the top corner casting of the lower container and a corner casting abutment face of the first container locking arrangement.

9. The side lift spreader according to claim 1, wherein the first container locking arrangement further comprises a presence sensor configured to sense, when the first container locking arrangement has been connected to the top corner casting of the lower container, a presence of the bottom corner casting of the upper container.

10. The side lift spreader according to claim 1, further comprising a second container locking arrangement arranged at a second longitudinal end of the spreader, the second container locking arrangement being configured in accordance with the first container locking arrangement.

11. A method of lifting stacked intermodal transport containers, the method comprising:

approaching the stacked intermodal transport containers from a longitudinal side;

inserting a lifting hook in a top corner casting of a lower container;

pivoting a male lock insert such that an upper male lock insert connects to a bottom corner casting of an upper container and a lower male lock insert connects to the top corner casting of the lower container; and receiving an indication that the lower male lock insert is properly connected to the top corner casting of the lower container.

12. The method according to claim 11, wherein a portion of said lower male lock insert is wider than the upper male lock insert, such that said portion of said lower male lock insert is too wide to fit in the bottom corner casting.

13. The method according to claim 11, further comprising providing an indicator body configured to interact with an inductive sensor when the lower male lock insert is properly connected to the top corner casting of the lower container.

14. The method according to claim 11, wherein no indication is received if an attempt is made to insert the lower male lock insert into the bottom corner casting of the upper container.

15. The method according to claim 11, wherein the method further comprises:

generating an electronic indication signal to a truck lifting the stacked intermodal transport containers.

16. The method according to claim 11, wherein the method further comprises:

sensing a presence of the bottom corner casting of the upper container.

17. A locking arrangement disposed on a side lift spreader for lifting stacked intermodal transport containers, the locking arrangement comprising:

an upper male lock insert configured to engage an upper container;

a lower male lock insert configured to engage a lower container, wherein a portion of said lower male lock insert is wider than the upper male lock insert; and an indicator comprising an indicator body configured to interact with an inductive sensor to provide an indication when the lower male lock insert is properly engaged with the lower container.

18. The locking arrangement of claim 17, wherein the lower male lock insert is configured to engage an opening of the lower container having a first horizontal width, and the upper male lock insert is configured to engage an opening of the upper container having a second horizontal width, wherein the second horizontal width is less than the first horizontal width.

19. The locking arrangement of claim 17, wherein the indicator body is too distant from the inductive sensor to generate an indication when said lower male lock insert is not engaged with the lower container.

20. The side lift spreader of claim 1, wherein said upper and lower containers are pursuant to at least one of ISO 668:2013 and ISO 1496-1:2013, such that said lower male lock insert is geometrically shaped to allow insertion into the top corner casting of the lower container and to prevent insertion of the lower male lock insert into the bottom corner casting of the upper container.

* * * * *